US011168935B2

(12) United States Patent
Wong et al.

(10) Patent No.: US 11,168,935 B2
(45) Date of Patent: Nov. 9, 2021

(54) REFRIGERATION APPLIANCE CABINET

(71) Applicant: FISHER & PAYKEL APPLIANCES LIMITED, Auckland (NZ)

(72) Inventors: Richard Wong, Auckland (NZ); Ian Campbell McGill, Auckland (NZ); Kenneth William Foster, Auckland (NZ); Yunchao Hou, Auckland (NZ)

(73) Assignee: FISHER & PAYKEL APPLIANCES LIMITED

( * ) Notice: Subject to any disclaimer, the term of this patent is extended or adjusted under 35 U.S.C. 154(b) by 22 days.

(21) Appl. No.: 16/492,523

(22) PCT Filed: Mar. 9, 2018

(86) PCT No.: PCT/NZ2018/050028
§ 371 (c)(1),
(2) Date: Sep. 9, 2019

(87) PCT Pub. No.: WO2018/164591
PCT Pub. Date: Sep. 13, 2018

(65) Prior Publication Data

US 2021/0140703 A1 May 13, 2021

(30) Foreign Application Priority Data

Mar. 9, 2017 (NZ) ..... 729914

(51) Int. Cl.
*F25D 23/06* (2006.01)
*F25D 23/00* (2006.01)

(52) U.S. Cl.
CPC ..... *F25D 23/062* (2013.01); *F25D 23/006* (2013.01); *F25D 23/066* (2013.01); *F25D 2201/12* (2013.01)

(58) Field of Classification Search
CPC ..... F25D 23/062; F25D 23/003; F25D 23/006
See application file for complete search history.

(56) References Cited

U.S. PATENT DOCUMENTS

| | | | | |
|---|---|---|---|---|
| 2,835,405 | A | 5/1958 | Gilbert et al. | |
| 3,276,222 | A | 10/1966 | Hutchinson | |
| 3,462,966 | A * | 8/1969 | Reid | F25D 21/04 62/248 |
| 3,948,410 | A | 4/1976 | Anderson | |
| 4,082,825 | A | 4/1978 | Puterbaugh | |

(Continued)

FOREIGN PATENT DOCUMENTS

| | | | |
|---|---|---|---|
| CA | 1335938 | C | 6/1995 |
| EP | 2789953 | A1 | 10/2014 |

(Continued)

*Primary Examiner* — Daniel J Rohrhoff
(74) *Attorney, Agent, or Firm* — Clark Hill PLC; James R. Foley

(57) ABSTRACT

A refrigeration cabinet assembly for a refrigeration appliance (1) comprises an insulated cabinet (20) having five closed faces and an open front face providing access to an interior of the cabinet. A torsionally stiff structure fixed to one of the five closed faces (23) or a structure (31) is added to one of the five closed faces (23) so that together with that closed face a torsionally stiff structure results. The torsional stiffness of the assembly is thereby increased beyond that of the cabinet alone so that the insulated cabinet has an improved ability to resist twisting.

15 Claims, 6 Drawing Sheets

(56) References Cited

U.S. PATENT DOCUMENTS

| | | | | |
|---|---|---|---|---|
| 4,580,852 | A | 4/1986 | Smitte et al. | |
| 4,586,348 | A * | 5/1986 | Nakayama | F25D 21/04 220/592.1 |
| 4,953,362 | A * | 9/1990 | Shoji | F25D 23/063 62/246 |
| 6,082,131 | A * | 7/2000 | Hirosawa | F25D 19/02 62/258 |
| 2005/0115265 | A1 * | 6/2005 | Ozaki | F25D 19/00 62/298 |
| 2009/0284116 | A1 | 11/2009 | Gorz et al. | |

FOREIGN PATENT DOCUMENTS

| | | | | |
|---|---|---|---|---|
| EP | 3647695 | A1 * | 5/2020 | F25D 23/006 |
| GB | 742011 | A | 12/1955 | |
| WO | WO-2020055273 | A1 * | 3/2020 | F25D 23/062 |

* cited by examiner

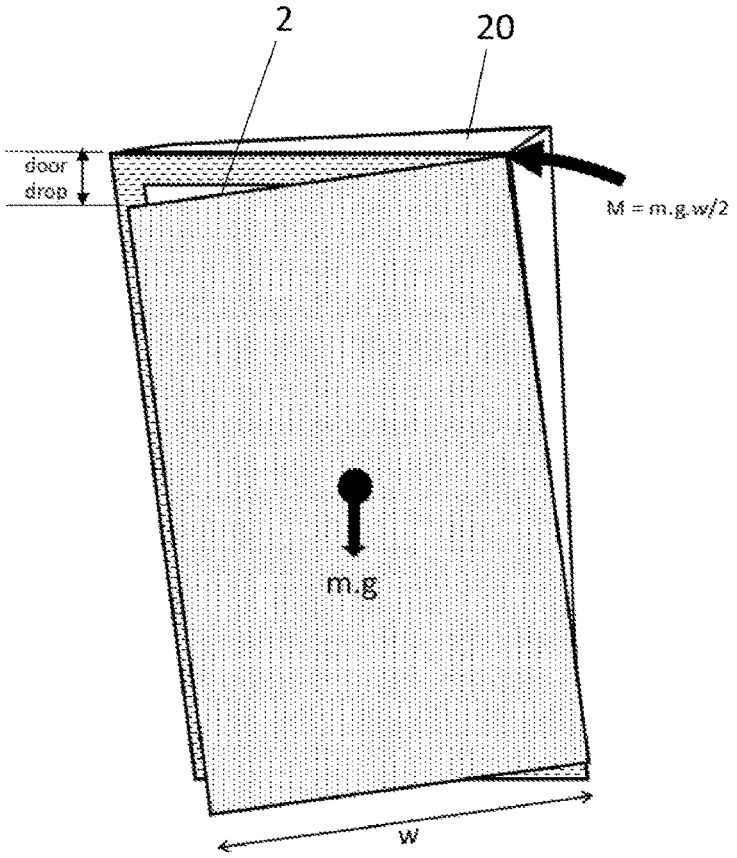
FIGURE 1A - Prior Art
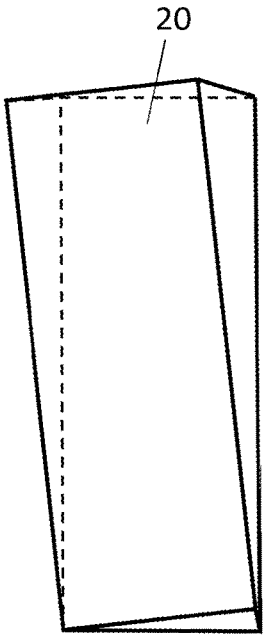
FIGURE 1B - Prior Art

REFRIGERATION APPLIANCE CABINET

This application is a National Phase Filing of PCT/NZ2018/050028, having an International filing date of Mar. 9, 2018, which claims priority of New Zealand Patent Application No. 729914, filed Mar. 9, 2017. The disclosure of the foregoing are hereby incorporated by reference.

TECHNICAL FIELD

The present invention relates to a cabinet assembly for a refrigeration appliance, and a refrigeration appliance comprising such a cabinet.

BACKGROUND ART

Since the 1960's refrigeration appliance cabinets (including free-standing and "built-in" refrigerators, freezers, combined refrigerator-freezers, cooling drawer-type refrigerators, wine cabinets and chest freezers) have been manufactured with "in situ" foamed polyurethane (PU) insulation. This construction usually has a sheet steel "wrapper" or skin on the outside, either a steel or a plastics (polystyrene-based or sheet steel) liner on the inside, and a rigid PU foam in a sandwich construction between the outer wrapper and the inner liner. The outer sheet steel wrapper was typically folded to produce a forward-facing flange that was welded at the corners.

With the drive to make refrigeration appliances more cost-efficient, the sheet steel outer panels have become thinner and the welding of the corners of forward facing flanges has been eliminated. Thus the modern refrigeration appliance cabinet relies on the sandwich construction of the outer wrapper, foam and inner liner for its structural integrity. This may be satisfactory for short-term loads, but the long-term loading from the door and food placed in shelving on an inner side of the door will force the cabinet structure to creep due to shear deflection of the foam, allowing the door to drop or droop relative to the cabinet. As the door droops, misalignment with the forward-facing cabinet flange occurs such that a door seal may not engage with the flange over at least a part of its extent and cold air may escape from a cooling compartment or compartments formed by the liner. The problem is exacerbated in tall or wide refrigeration appliance cabinets which may have a heavier door and carry more weight in the door, presenting a greater force acting to deform the refrigeration appliance cabinet. Also, there is a modern trend towards "built-in" appliances which include an additional, and often heavy, door panel attached to the outside of the cabinet door so that the appliance may match surrounding cabinetry thus accentuating door droop.

This door drop is usually countered by adding structural steel to the perimeter of the cabinet, behind the forward-facing flange. The structural steel has the disadvantage that it presents a thermal heat flow path that allows heat leakage into the cabinet, reducing operational efficiency.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF INVENTION

It is an object of the present invention to provide an improved refrigeration appliance assembly or an improved refrigeration appliance that will go at least some way towards overcoming at least some of the above-mentioned disadvantages, or which will provide the industry or public with a useful choice.

In a first aspect, the invention consists in a refrigeration appliance assembly comprising:

- an insulated cabinet comprising five closed faces and an open face providing access to an interior of the cabinet, and
- a torsionally stiff structure fixed to or comprising one of the five closed faces to substantially increase torsional stiffness of the assembly beyond that of the insulated cabinet alone so that the insulated cabinet has an increased ability to resist twisting.

In some embodiments, the insulated cabinet comprises an outer skin, an inner liner, and an insulating material between the outer skin and inner liner, and wherein the torsionally stiff structure is fixed to or comprises a closed face of the outer liner.

In some embodiments, the torsionally stiff structure is fixed to or comprises a bottom face or a top face of the insulated cabinet.

In some embodiments, the torsionally stiff structure is sized to accommodate a refrigeration system or refrigeration system components of the refrigerator, for example at least a compressor.

In some embodiments, the torsionally stiff structure forms a plinth for the insulated cabinet.

In some embodiments, the torsionally stiff structure comprises a 3-dimensional structure surrounding a central volume.

In some embodiments, the torsionally stiff structure comprises six sides wherein each side is either closed so that access to the central volume via that side is prevented, or open so that access to the central volume via that side is possible.

In some embodiments, the torsionally stiff structure comprises a space frame.

In some embodiments, the torsionally stiff structure comprises a sheet metal box.

In some embodiments, the box comprises at least one open side and the box is fixed to the insulated cabinet so that an open side of the box is closed by a closed face of the insulated cabinet, the closed face of the insulated cabinet and the box forming the torsionally stiff structure.

In some embodiments, the box has an open top side and is attached to the bottom closed face of the insulated cabinet so that the open top side of the box is closed by the bottom closed face of the insulated cabinet, the bottom closed face of the insulated cabinet and the box forming the torsionally stiff structure.

In some embodiments, the sheet metal box has a front side, and comprises at least one gusset at a substantially open front side, each gusset attached between adjacent sides of the box.

In some embodiments, the sheet metal box has closed sheet metal vertical sides, a closed sheet metal bottom side and a closed sheet metal rear side.

In some embodiments, the sheet metal of the box has a thickness greater than a thickness of an outer skin of the insulated cabinet.

In some embodiments, the thickness of the sheet metal of the box is at least twice the thickness of the outer skin of the insulated cabinet.

In some embodiments, the assembly further comprises refrigeration system components housed in the torsionally stiff structure.

In another aspect, the invention consists in a refrigeration appliance comprising the assembly as described in the first aspect, optionally as modified by any one of the above statements describing embodiments, and a door operatively rotationally connected to the insulated cabinet to selectively open or close the open front face of the insulated cabinet.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the terms "pivotally" and "rotationally" (for example, the door is pivotally/rotationally connected/attached/coupled to a cabinet) includes both a purely rotational relative movement about an axis, as well as a combination of rotation about an axis and translation of that axis (an example of the combined rotation and translation being provided by a door connected to a cabinet by an articulated hinge).

The terms "torsionally stiff" and "torsionally weak" (and equivalents) used herein are relative terms meaning, respectively, having the ability to substantially resist twisting by a torque resulting from an applied force in an operational range normally expected to be encountered by a refrigerator cabinet, and not having the ability to substantially resist that torque.

As used herein the term "and/or" means "and" or "or", or both.

As used herein "(s)" following a noun means the plural and/or singular forms of the noun.

The term cuboid is intended to mean, unless the context indicates otherwise, a 3-dimensional structure such as a rectangular prism, comprising six main sides or faces (for example a rectangular cuboid or a square cuboid). One or more main sides may be open faces, for example an open framework (a space frame) or closed faces of the cuboid.

This invention may also broadly be said to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF DRAWINGS

Preferred embodiments of the invention will be described by way of example only and with reference to the accompanying drawings, in which:

FIG. 1A is a schematic front view representation of a refrigeration appliance illustrating deformation or twisting of a torsionally weak cabinet and the resulting 'door drop' or droop caused, over an extended period of time, by the mass of the door and food supported by the door.

FIG. 1B is a schematic representation side view from a door hinge side of the twisted refrigeration appliance illustrated in FIG. 1A.

DESCRIPTION OF EMBODIMENTS

Figure 2A:
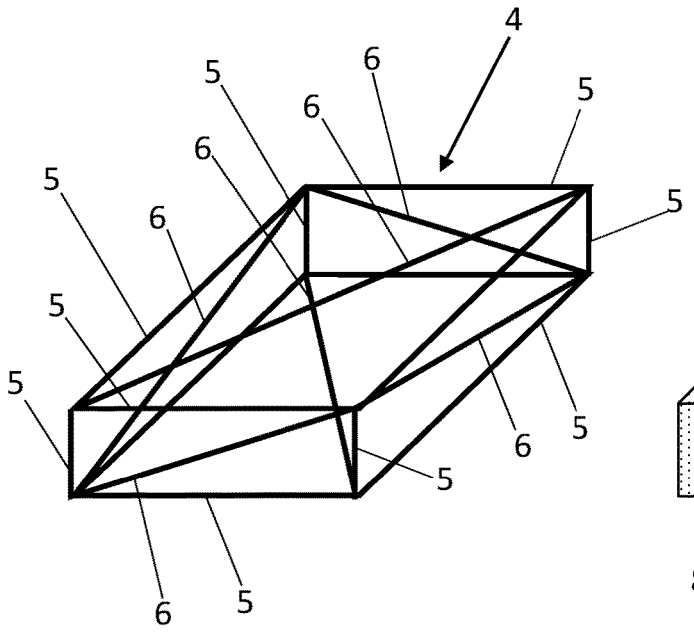
FIGS. 2A to 2D illustrate exemplary torsionally stiff structures.

Various embodiments will now be described with reference to the drawing Figures. Throughout the drawing Figures and specification, the same reference numerals may be used to designate the same or similar components, and redundant descriptions thereof may be omitted.

Figure 6A:
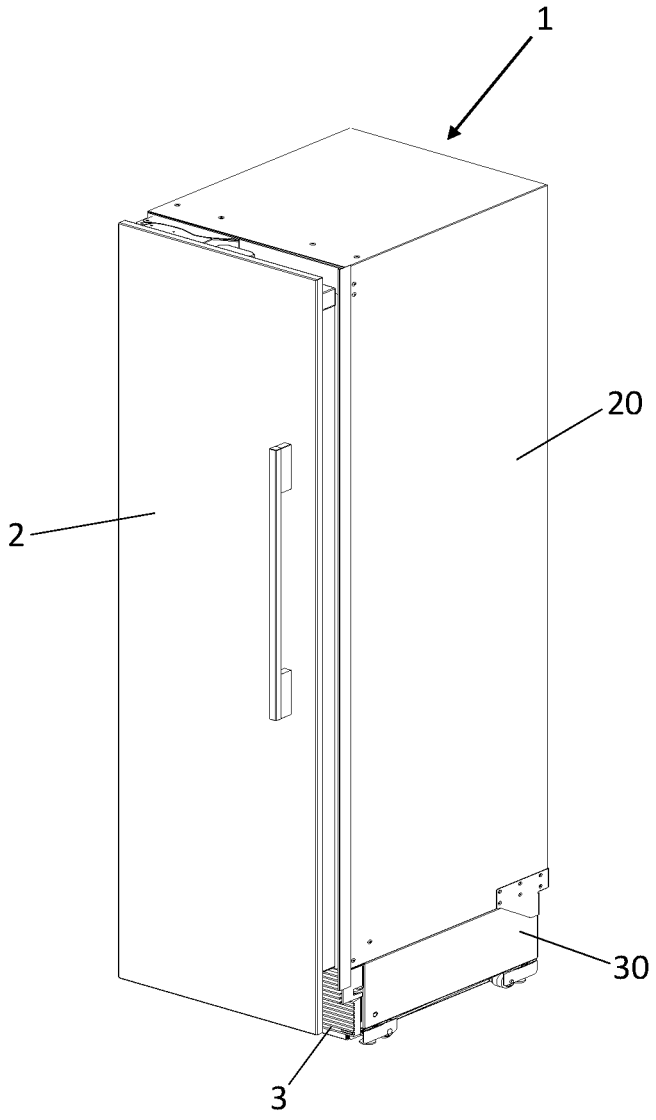
FIGS. 6A and 6B illustrate a fully-assembled refrigeration appliance comprising the cabinet with torsionally-stiff structure shown in FIG. 3A or 3B, FIG. 6A being an isometric view and FIG. 6B a front view.
Figure 6B:
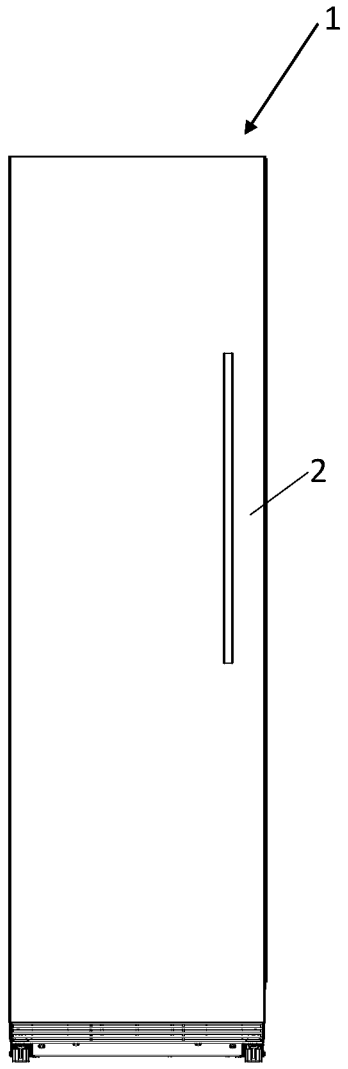

A refrigeration appliance 1 according to some embodiments of the present invention is illustrated in FIGS. 6A and 6B. The refrigeration appliance comprises an insulated cabinet 20 with an open front face, and a door 2 for selectively opening and closing the front face. The overall height of the refrigeration appliance may, for example, be around 84 inches (around 213 cm) which is relatively tall for modern refrigeration appliances. The door 2 is openably operatively connected (such as via a rotational or pivotal connection) to the cabinet 20 by hinges (such as articulated hinges, one of which is visible at the top edge of the door in FIG. 6A) at one side thereof to selectively close the open face of the cabinet. The door may have shelves on an inner side for supporting food or bottles. The refrigeration appliance shown in FIGS. 6A and 6B is of the "built-in" variety and so its outer front face is part of a door panel removably and adjustably attached to the actual hinged insulated cabinet door below.

With reference to FIGS. 1A and 1B, a mass m of the door 2 (and any food supported on shelves on the inner side of the door) creates a moment M at a side of a torsionally weak insulated refrigeration appliance cabinet 20 to which the door is pivotally/rotationally connected. The moment M forces the rectangular front open face of the refrigeration appliance cabinet (and each of the other faces) into a substantially parallelogram shape, when viewed from the front of the cabinet.

The refrigeration appliance cabinet 20 comprises five closed faces; the left and right sides, top, bottom and back faces. By "closed", it is meant that the side or face does not allow a user access therethrough for adding/removing articles to/from a volume enclosed by the cabinet whereas an "open" side or face allows a user access therethrough to the enclosed volume.

Cabinet 20 may, at least in part, be formed by folding sheet metal (such as painted steel or stainless steel) to form at least a part of the cabinet wrapper. For example, the two longer, vertical side panels/closed faces and the top panel/closed face may be formed by folding a single sheet of metal into a substantially upside-down "U"-shape and the back and bottom panels/closed faces may be attached thereto by, for example riveting or welding. If the five closed faces are rigidly joined (or continuous, in the case of folding to form at least some of the panels) along their coincident edges, the moment M produced by the door's weight will cause the cabinet to deflect as shown in FIGS. 1A and 1B, with each of the edges retaining their original length. The only significant deformation is that all five closed faces of the cabinet twist. Being formed from a material such as sheet steel, each closed face is very stiff in the planar direction of the face, however each face can bend or twist out of its plane. To aid in understanding, the shape of a deformed cabinet and face resulting from moment M acting on the torsionally weak cabinet may be reproduced by holding still one of the top or bottom faces of a torsionally weak rectangular prism (such as a cardboard box) while twisting the other of the top or bottom face of the box about an axis through the top and bottom faces.

The present invention seeks to actively eliminate the twist in one face of the cabinet. Actively eliminating twist in one face of the cabinet passively prevents or obstructs all of the other cabinet faces twisting and therefore prevents the entire cabinet from deforming significantly. According to the present invention, deformation of the refrigeration appliance cabinet, and therefore door drop relative to the cabinet, is eliminated or reduced to an acceptable level by adding a torsionally rigid or stiff structure to one of the five closed faces of the cabinet. That is, a structure is added (i.e., attached, coupled, fixed or connected) to the cabinet so that the torsional rigidity/stiffness of the resulting assembly (i.e., cabinet+structure) is greater than that of the cabinet alone.

In some embodiments, the cabinet comprises an outer skin or wrapper, inner liner, and an insulating material in between. The sheet steel forming the wrapper may be for example steel sheet with a thickness of less than 1 mm, preferably between about 0.4 mm and 0.6 mm, most preferably about 0.5 mm. The cabinet is a torsionally weak structure, due at least in part to the relatively thin section of the sheet material. The folded corners or edges between the side and top panels present relatively rigid edges between the top and sides of the cabinet. Connections between the "U"-shaped sheet and the base and back panels are also rigid, for example by riveting or by other connecting means known in the art. The front of the cabinet comprises an open face to provide access to the inside of the cabinet via a door of the refrigeration appliance.

Torsionally weak, in relation to the cabinet, means that in response to an appropriately-directed force or moment having a magnitude within an expected operational loading range, the closed faces of the cabinet can relatively easily twist out of plane. As a result the cabinet twists and the shape of the open front face of the cabinet deforms from a rectangle to a parallelogram (when viewed from in front of the cabinet) which is no longer substantially planar. Deformation of the cabinet may prevent the door from sealing the cooling compartments within the cabinet when in a closed position.

In order to prevent the torsionally weak cabinet from twisting, a torsionally stiff structure is provided to one of the five closed faces of the cabinet. For example, a torsionally stiff structure may be provided to the top face or the bottom face of the cabinet. Alternatively, a thin torsionally stiff structure may be provided to a left or right side face, or a rear face of the cabinet. In a preferred embodiment, a torsionally stiff structure is applied to the bottom or top closed face of the cabinet since typically within a building space (e.g., in a kitchen) in which a refrigeration appliance is located there is sufficient vertical height to accept a torsionally stiff structure above or below the cabinet. The torsionally stiff structure may be an auxiliary structure, attached to the cabinet subsequent to the cabinet's construction, or it may be built into the cabinet structure during the cabinet's construction. At least a part of the torsionally stiff structure may also be formed integrally with at least part of the cabinet (for example, as a folded box formed from the same sheet of steel as one or more of the panels of the cabinet) or could be formed from components completely distinct and separate from components used in the construction of the cabinet. The torsionally stiff structure could be a combination of an auxiliary structure and an existing part (such as a side or face) of the cabinet.

A torsionally stiff structure is a structure that does not significantly twist under normal operational loading. That is, when one end or face of the structure is held firmly, the structure is able to resist rotation of an opposite end of the structure about an axis through both ends (see FIG. 1A). A thick solid plate may be sufficiently rigid to act as a torsionally stiff structure, for example a thick steel plate having a thickness of more than 5 mm. The torsionally stiff structure could be a continuous, solid thick plate or could be a frame (e.g. a 2-dimensional frame like a picture frame) cut from a solid thick plate. However, a thick plate or frame may be less preferred as it may provide a thermal heat flow path to the inside of the refrigeration appliance (if used on the inside of the wrapper such that it displaces an amount of insulation) and is an inefficient use of material.

Exemplary torsionally stiff structures that are efficient in their material usage are illustrated in FIGS. 2A to 2D. In some embodiments, the torsionally stiff structure comprises a 3-dimensional framework. In some embodiments, the torsionally stiff structure comprises a hollow cuboid or rectangular prism, e.g. a cuboid framework or a hollow cuboid with one or more closed faces.

FIG. 2A illustrates a torsionally stiff structure comprising a cuboid space frame 4, the space frame 4 comprising a rigid member or strut 5 along or forming each edge of the frame and rigid diagonal members 6 across each open face or side of the space frame between diagonally opposed corners. The diagonal members 6 may be oppositely arranged in opposing sides of the framework 4. In some embodiments, each side of the space frame may comprise a diagonal member between adjacent perimeter edge members. In some embodiments the space frame 4 may comprise a diagonal member across five sides of the framework, and with a single side without a diagonal member to be attached to a closed side of the cabinet. In some embodiments the space frame may be without diagonal members, for example in a welded construction comprising edge members 5 that provide sufficient corner rigidity without diagonal members.

Figure 2B:
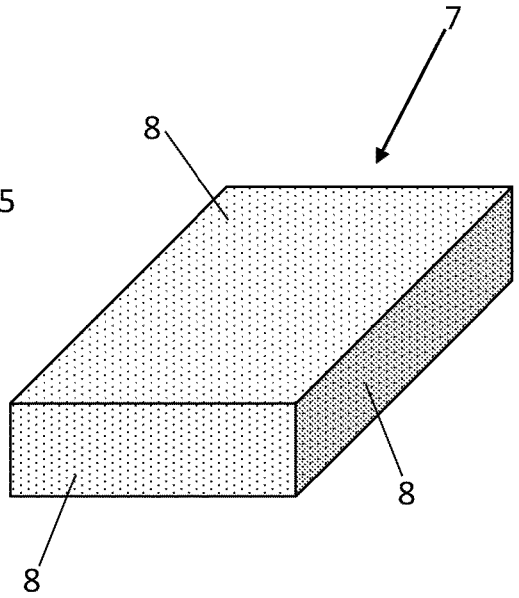

FIG. 2B illustrates a torsionally stiff structure comprising a sheet metal box 7 or cuboid. All six main sides 8 of the box comprise sheet metal, e.g. a sheet metal panel such as sheet steel. The thickness of the sheet metal-forming closed faces of the box is sufficiently thick to prevent twisting of the box.

For example, where the thickness of the outer skin of the torsionally weak cabinet is about 0.5 mm, the thickness of the sheet metal box formed from the same material (such as sheet steel) as the cabinet and providing a torsionally stiff structure may be between about 0.5 mm to about 1.5 mm. The thickness of the sheet metal forming the box may, purely as an example, be at least about 1.5 times the thickness of the outer skin of the refrigeration appliance cabinet. Some faces could be thinner than others.

Figure 2C:
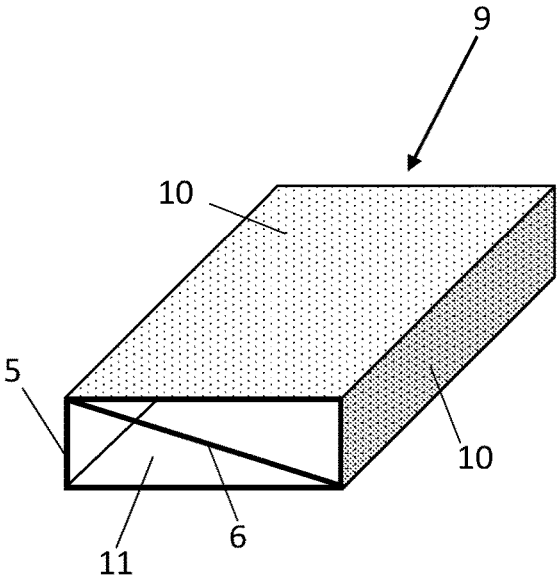

FIG. 2C illustrates a torsionally stiff structure comprising a box or cuboid 9 having five sheet metal, closed faces 10 and a sixth face or side 11 (the front side in the drawing figure) comprising a framework. The framework comprises four rigid perimeter or edge members 5 and a rigid diagonal member 6 in the plane of the open face to stiffen the open face. Other combinations of closed and open faces may be provided, for example a structure comprising four sheet metal, closed faces 10 and two opposed, open framework faces 11, each framework face comprising four rigid perimeter members 5 and one or more rigid diagonal member(s) 6 for stiffening an open face or faces, for example as described with reference to FIG. 2A. As an alternative to diagonal stiffening members, open faces could be stiffened by corner gussets, for example.

Figure 2D:
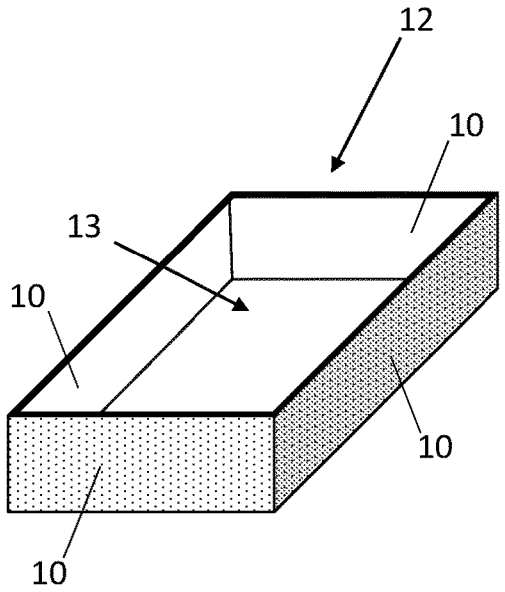

FIG. 2D illustrates a box or cuboid 12 comprising five sheet metal closed faces 10 and a sixth, open face 13. A closed face of the torsionally weak cabinet closes or provides the sixth face of the torsionally stiff structure.

In some embodiments the torsionally stiff structure comprises a cuboid sized to accommodate components of a refrigeration system of the refrigeration appliance, for example a compressor and condenser with pipework connecting to at least one evaporator for cooling at least one compartment within the cabinet. For example, the structures illustrated in FIGS. 2A to 2D may be formed to encompass a sufficiently large volume to beneficially accommodate such a refrigeration system, in addition to preventing or reducing twisting of the cabinet.

Figure 3A:
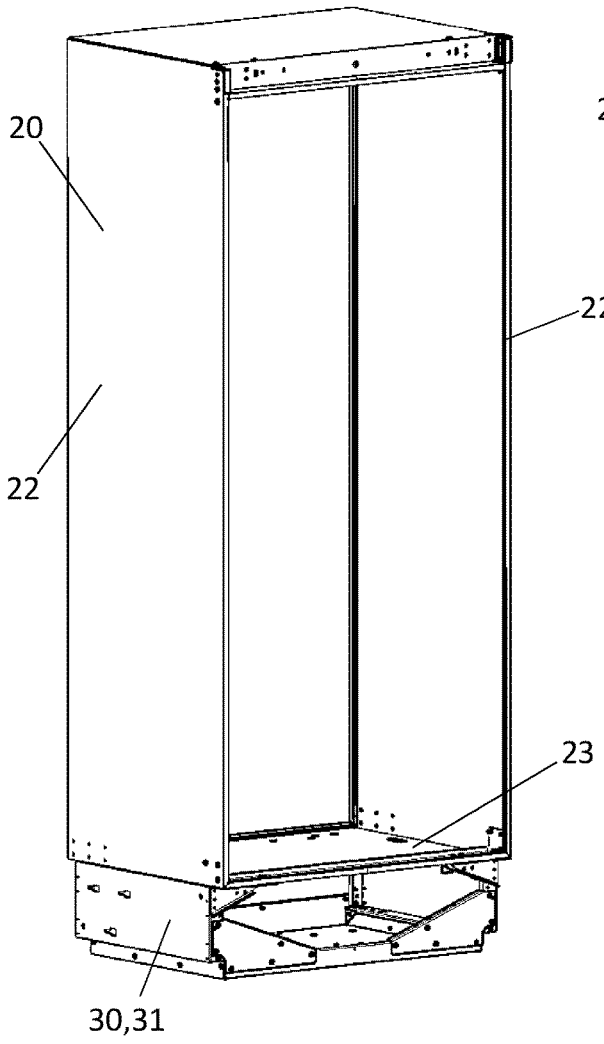
FIGS. 3A and 3B each show a refrigeration appliance assembly including a common torsionally weak cabinet and a torsionally-stiff structure located at a base or bottom side of the cabinet in accordance with two different embodiments of the present invention, respectively.
Figure 3B:
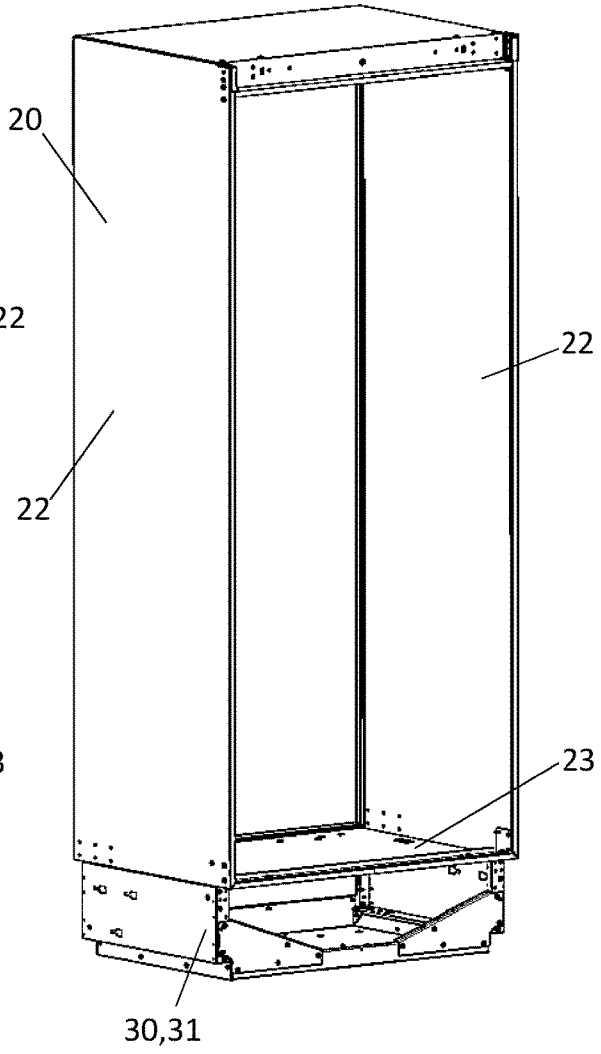

FIGS. 3A and 3B show two embodiments each comprising a torsionally weak cabinet 20 and a torsionally stiff structure 30 located at and rigidly secured to a base or bottom side of the torsionally weak cabinet 20. The illustrated cabinet 20 may be the outer skin for an insulated cabinet comprising the outer skin, an inner liner and insulation between the outer skin and inner liner, the cabinet having five closed faces and an open front face. The torsionally stiff structures 30 in FIGS. 3A and 3B are each sized to house components of a refrigeration system for the refrigeration appliance. As the torsionally stiff structure is located at the bottom of the cabinet the torsionally stiff structure beneficially acts as a plinth for the cabinet to house refrigeration components below the cabinet and raise the cabinet (and its enclosed compartments) slightly to ease access by a user.

Figure 4A:
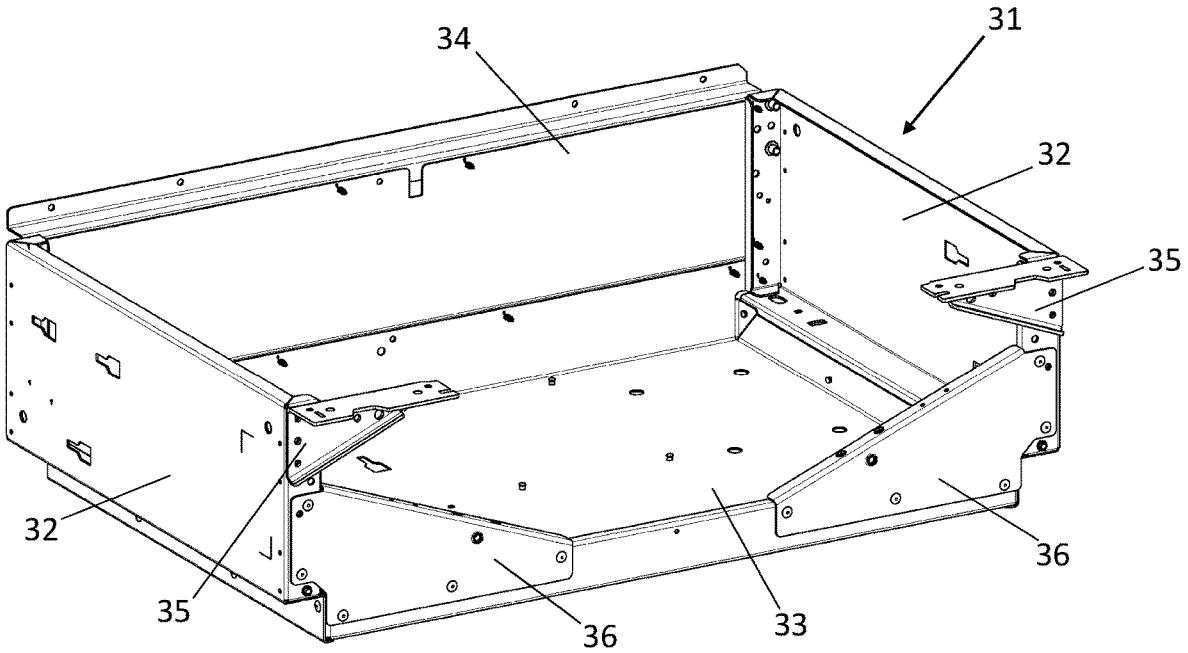
FIGS. 4A and 4B each show an enlarged view of the box or cuboid structure that, together with the base panel (not shown) of the attached cabinet, forms one of the torsionally stiff structures in FIGS. 3A and 3B, respectively.
Figure 4B:
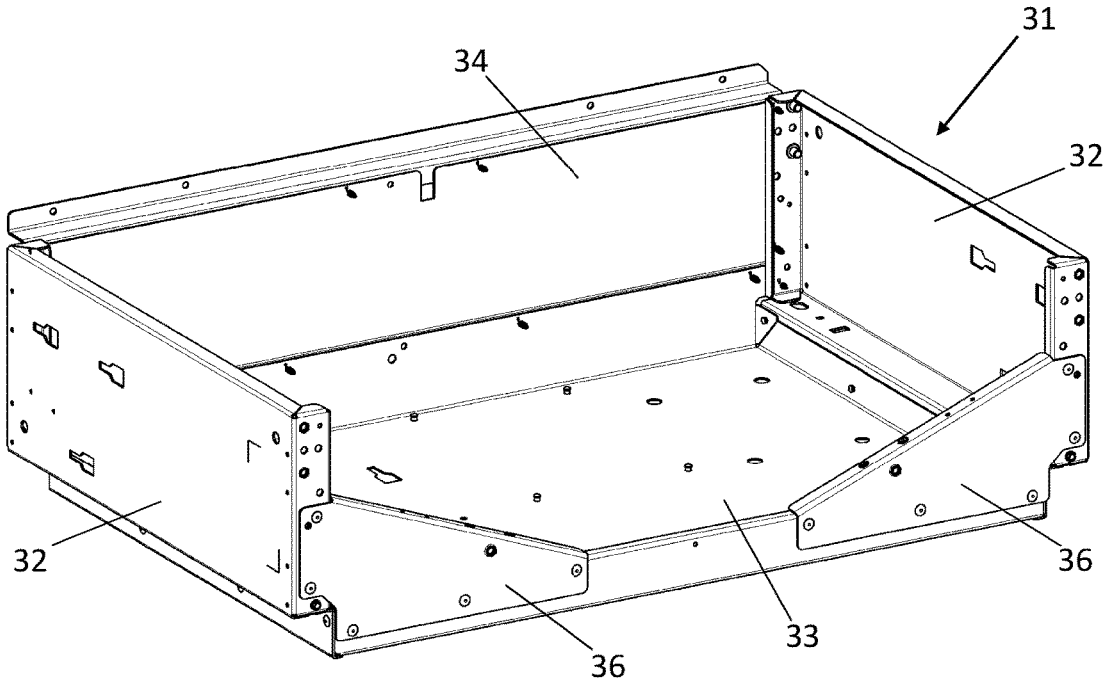

In each of FIGS. 3A and 3B the torsionally stiff structure 30 includes a cuboid or box 31. The box 31 shown together with the cabinet 20 in FIGS. 3A and 3B is shown separated from the cabinet 20 in FIGS. 4A and 4B. The box 31 comprises four main closed faces; left and right faces 32, a bottom face 33 and a rear face 34. A front side is open and the box is stiffened by corner gussets 35, 36 provided at or near to the open front face of the box 31. The open front face allows for access to the refrigeration system components, for example for maintenance and/or for air flow. The open front face may be covered by a grill or grate, e.g. grate 3 shown in FIG. 6A. The door 2 (or at least the outer panel attached to the actual door) of the refrigeration appliance may cover the front face of the box 31 when in a closed position, as shown in FIG. 6A. Each gusset is attached to two adjacent sides of the box, or to a side of the box and a face of the cabinet 20. For example, in the figures each gusset 36 is attached to a vertical side 32 and a horizontal side 33 of the structure while each gusset 35 is attached to a vertical side 32 and the base panel 23 of the cabinet 20. In FIGS. 3A and 4A the box 31 is stiffened by four gussets 35, 36. Two gussets 36 are attached to a vertical side 32 and to the bottom side 33 of the box, and two gussets 35 attached to vertical side 32 and bottom face 23 of the cabinet 20, the four gussets 35, 36 positioned at each corner of the open face so that a considerable central opening remains in that face. In FIGS. 3B and 4B, the box is stiffened by two gussets 36, each attached to a vertical side 32 of the box and the bottom 33 of the box 31.

The gussets may be formed from the same sheet steel material (and thickness) as the material used to form box 31. In some embodiment two gussets or four gussets may be integrally formed, e.g. cut and/or folded to form a monolithic component from a single blank or sheet material. The gussets may be substantially planar and attachment to a panel may be via a flange formed on that panel, perpendicular to the panel, such as gusset 36. Alternatively, the gussets could be formed with a perpendicular flange at an edge or edges thereof adapted to be fastened directly to the face of an adjacent panel, such as gusset 35.

Figure 5A:
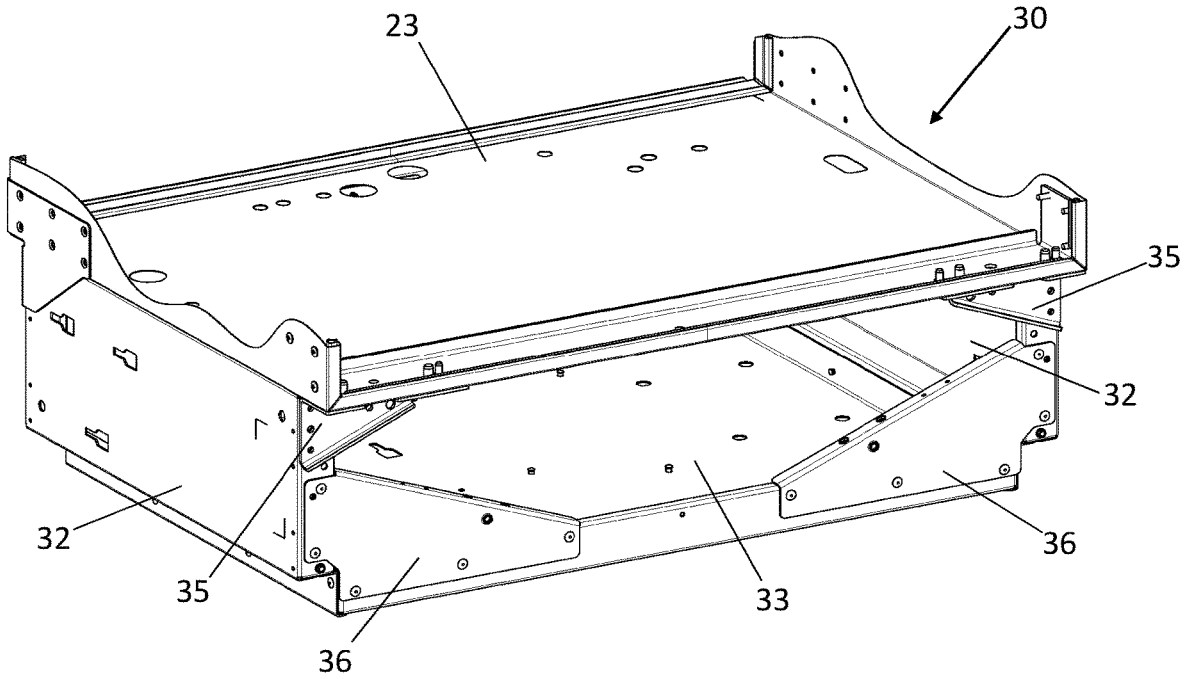
FIGS. 5A and 5B show the torsionally stiff structure embodiments in FIGS. 3A and 3B respectively, comprising the boxes from FIGS. 4A and 4B and the bottom panel of the cabinet, cut away from the vertical sides of the cabinet.
Figure 5B:
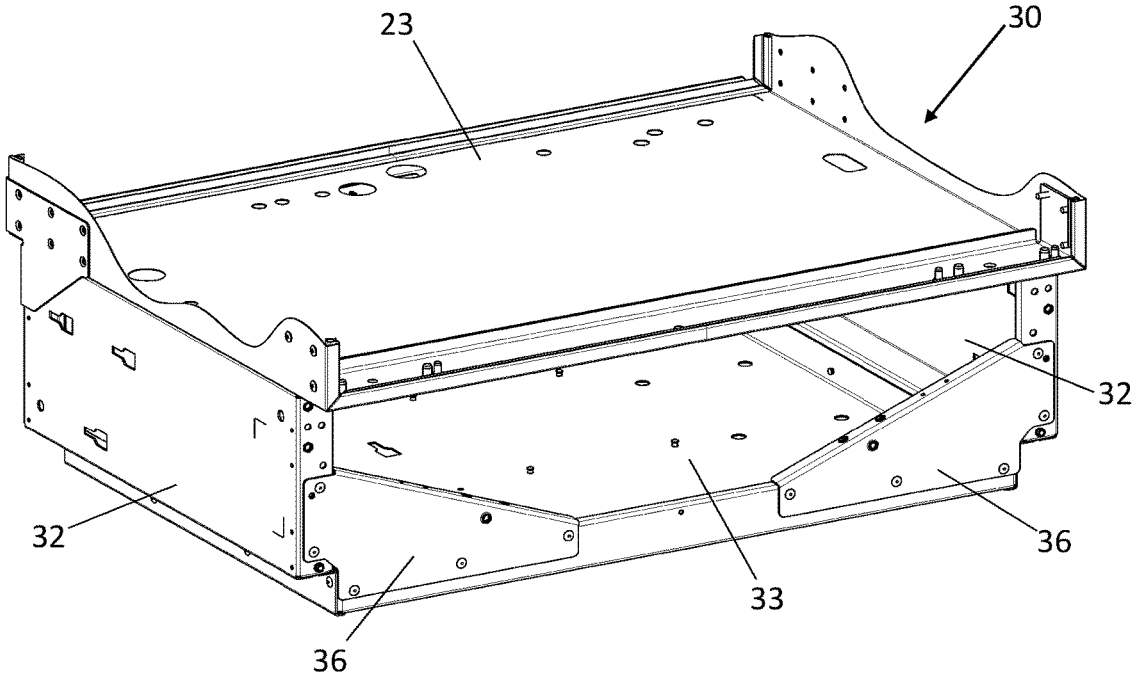

In FIGS. 3A, 4A and 3B, 4B, the top side of the box 31 is open. The open top side of the box is closed by attaching the box to the base or closed bottom face 23 of the cabinet 20, for example as explained above with reference to FIG. 2D. The box 31 is rigidly fixed to the bottom side 23 of the cabinet. Thus in FIGS. 3A and 3B, the bottom panel 23 of the cabinet closes the top side of the box 31 to create a torsionally stiff structure 30 comprising five closed main sides (the top 23, bottom 33, rear 34 and left and right sides 32) and an open front with two or four gussets at the open front. FIGS. 5A and 5B show the torsionally stiff structure 30 comprising the box 31 and the bottom panel 23 of the cabinet cut away from the vertical sides 22 of the cabinet 20. In use, the cabinet bottom 23, which is also the top side of the torsionally rigid structure 30, is prevented from twisting because it is an integral part of a torsionally stiff assembly comprising the other five sides of the box 31, which thereby prevents the entire cabinet 20 from twisting.

It will be appreciated that the box 31 itself, having an open top face, is not substantially torsionally stiff, but when rigidly fixed to base 23 the torsionally stiff structure 30 results. Alternatively, the box could also include a closed upper face, thereby increasing the torsional stiffness of the box and making the box itself torsionally stiff. The closed upper face of the torsionally stiff box could then be rigidly fixed to the cabinet bottom face 23 to produce a refrigeration cabinet assembly having a torsional stiffness greater than the torsional stiffness of the cabinet on its own.

The cabinet must be reliably and strongly attached to the torsionally stiff structure without allowing relative movement or flexing therebetween, otherwise the cabinet will be able to twist. In some embodiments the torsionally stiff structure or box is rigidly fixed to the outer skin of the cabinet by welding, riveting, screws or other suitable fasteners, or by any other rigid fixing means know in the art that will substantially avoid any relative sliding movement between adjacent faces of the cabinet and torsionally stiff structure.

The left and right sides 32, bottom 33 and rear 34 sides of box 31 may be folded from sheet metal, or may be separate panels fixed together, or any combination of folding and fixing. The thickness of the sheet metal may be thicker than the thickness of the outer skin of the cabinet. The gussets may be formed from sheet metal and may have the same thickness as the metal forming the closed sides of the box or may be formed from an alternative material having adequate stiffness.

The present invention utilises a torsionally stiff structure fixed to or comprising one face of the refrigeration appliance cabinet to allow cost to be removed from the cabinet (auxiliary structural components in the cabinet such as reinforcing steel around the door opening are not required) which also improves the thermal insulation of the cabinet (by enabling insulating foam to replace the volume previously occupied by the removed heat-conducting structural components), and reduces material usage.

As mentioned above, the torsionally stiff structure may be attached to or include any one (or more) of the sides of the cabinet. The torsional resistance of the side of the cabinet with the torsionally stiff structure stops or restrains that side of the cabinet from twisting, which means that none of the sides of the cabinet can twist. Because the cabinet cannot twist, the door attached to a front open face of the cabinet cannot droop so that the door stays in alignment with the open front face of the cabinet, and the door seal stays engaged with the peripheral front flange of the cabinet door opening when the door is in a closed position.

The foregoing description of the invention includes preferred forms thereof. Modifications may be made thereto without departing from the scope of the invention as defined by the accompanying claims.

The invention claimed is:

1. A refrigeration appliance assembly comprising:

an insulated cabinet comprising five closed faces and an open face providing access to an interior of the cabinet, and a torsionally stiff structure fixed to or comprising one of the five closed faces to stop or restrain the closed cabinet face to which it is attached, or which it includes, from twisting and thereby to substantially increase torsional stiffness of the assembly beyond that of the insulated cabinet alone so that the insulated cabinet has an increased ability to resist twisting, wherein the torsionally stiff structure is a sheet metal box.

2. The assembly as claimed in claim 1, wherein the insulated cabinet comprises an outer skin, an inner liner, and an insulating material between the outer skin and inner liner, and wherein the torsionally stiff structure is fixed to or comprises a closed face of the outer skin.

3. The assembly as claimed in claim 1, wherein the torsionally stiff structure is fixed to or comprises a bottom face or a top face of the insulated cabinet.

4. The assembly as claimed in claim 1, wherein the torsionally stiff structure is sized to accommodate at least a compressor for a refrigeration system.

5. The assembly as claimed in claim 1, wherein the torsionally stiff structure forms a plinth for the insulated cabinet.

6. The assembly as claimed in claim 1, wherein the torsionally stiff structure comprises a 3-dimensional structure surrounding a central volume.

7. The assembly as claimed in claim 6, wherein the torsionally stiff structure comprises six sides wherein each side is either closed so that access to the central volume via that side is prevented, or open so that access to the central volume via that side is possible.

8. The assembly as claimed in claim 1, wherein the sheet metal box comprises at least one open side and the sheet metal box is fixed to the insulated cabinet so that an open side of the sheet metal box is closed by a closed face of the insulated cabinet, the closed face of the insulated cabinet and the sheet metal box forming the torsionally stiff structure.

9. The assembly as claimed in claim 1, wherein the sheet metal box has an open top side and is attached to the bottom closed face of the insulated cabinet so that the open top side of the sheet metal box is closed by the bottom closed face of the insulated cabinet, the bottom closed face of the insulated cabinet and the sheet metal box forming the torsionally stiff structure.

10. The assembly as claimed in claim 1, wherein the sheet metal box has a substantially open front side, and comprises at least one gusset at the front side, each gusset attached between adjacent sides of the sheet metal box.

11. The assembly as claimed in claim 1, wherein the sheet metal box has closed sheet metal vertical sides, a closed sheet metal bottom side and a closed sheet metal rear side.

12. The assembly as claimed in claim 1, wherein the sheet metal of the sheet metal box has a thickness greater than a thickness of an outer skin of the insulated cabinet.

13. The assembly as claimed in claim 12, wherein the thickness of the sheet metal of the sheet metal box is at least twice the thickness of the outer skin of the insulated cabinet.

14. The assembly as claimed in claim 1, further comprising refrigeration system components housed in the torsionally stiff structure.

15. A refrigeration appliance comprising the assembly as claimed in claim 1, and a door operatively rotationally connected to the insulated cabinet to selectively open or close the open face of the insulated cabinet.

* * * * *